US009608318B2

(12) United States Patent
Tan et al.

(10) Patent No.: US 9,608,318 B2
(45) Date of Patent: Mar. 28, 2017

(54) ANTENNA ASSEMBLIES AND METHODS OF MANUFACTURING THE SAME

(71) Applicant: Laird Technologies, Inc., Earth City, MO (US)

(72) Inventors: Yen Siang Tan, Penang (MY); Chit Yong Hang, Penang (MY)

(73) Assignee: Laird Technologies, Inc., Earth City, MO (US)

( * ) Notice: Subject to any disclaimer, the term of this patent is extended or adjusted under 35 U.S.C. 154(b) by 706 days.

(21) Appl. No.: 14/086,365

(22) Filed: Nov. 21, 2013

(65) Prior Publication Data

US 2015/0138037 A1 May 21, 2015

Related U.S. Application Data

(60) Provisional application No. 61/906,518, filed on Nov. 20, 2013.

(51) Int. Cl.
*H01Q 1/50* (2006.01)
*H01Q 1/36* (2006.01)
(Continued)

(52) U.S. Cl.
CPC ..... *H01Q 1/362* (2013.01); *H01Q 1/244* (2013.01); *H01Q 5/385* (2015.01); *Y10T 29/49016* (2015.01)

(58) Field of Classification Search
CPC ..... H01Q 1/362; H01Q 1/244; H01Q 5/385
(Continued)

(56) References Cited

U.S. PATENT DOCUMENTS 3,523,251 A * 8/1970 Halstead ..... H01Q 1/3275 343/701
4,229,743 A 10/1980 Vo et al.
(Continued)

FOREIGN PATENT DOCUMENTS

CN 101449430 6/2009
CN 102035062 4/2011
(Continued)

*Primary Examiner* — Dameon E Levi
*Assistant Examiner* — Ab Salam Alkassim, Jr.
(74) *Attorney, Agent, or Firm* — Harness, Dickey & Pierce, P.L.C.

(57) ABSTRACT

According to various aspects, exemplary embodiments are disclosed of antenna assemblies and methods of manufacturing the same. In an exemplary embodiment, a method generally includes forming (e.g., molding, etc.) a sleeve over and/or between a first portion of a first component (e.g., a bushing, etc.) and a second portion of a second component (e.g., adaptor, etc.). The sleeve is coupled to the first and second portions of the respective first and second components. The method may also include removably attaching an antenna connector subassembly to the first component such that a printed circuit board assembly of the antenna connector subassembly is covered by the sleeve. The method may additionally include overmolding a sheath over the sleeve and one or more radiating elements of a multiband antenna assembly that includes the antenna connector subassembly, whereby the sleeve covers and protects the printed circuit board assembly during the overmolding.

21 Claims, 10 Drawing Sheets

(51) Int. Cl.
*H01Q 1/24* (2006.01)
*H01Q 5/385* (2015.01)

(58) Field of Classification Search
USPC ..... 343/702, 850, 860, 895
See application file for complete search history.

(56) References Cited

U.S. PATENT DOCUMENTS 4,435,713 A * 3/1984 Gasparaitis ..... H01Q 9/30 343/702
4,772,895 A * 9/1988 Garay ..... H01Q 1/362 343/752
5,835,064 A * 11/1998 Gomez ..... H01Q 1/242 343/702
5,995,050 A * 11/1999 Moller ..... H01Q 1/244 343/702
7,688,277 B2 * 3/2010 Brocheton ..... H01Q 1/1207 343/850
7,817,103 B2 * 10/2010 Kersten ..... H01Q 1/241 343/895
7,969,379 B2 6/2011 Knudsen et al.
8,743,009 B2 * 6/2014 Packer ..... H01Q 1/242 343/822
2004/0189535 A1 * 9/2004 Kim ..... H01Q 1/242 343/702
2006/0250319 A1 * 11/2006 Ooi ..... H01Q 1/362 343/895
2007/0120747 A1 * 5/2007 Candal ..... H01Q 1/243 343/702
2009/0021445 A1 * 1/2009 Knudsen ..... H01Q 11/083 343/850
2009/0219220 A1 * 9/2009 Kersten ..... H01Q 1/241 343/860

FOREIGN PATENT DOCUMENTS

KR 1020050074380 7/2005
WO WO 98/49747 11/1998
WO WO 2007/139654 12/2007
WO WO 2013/028052 2/2013

* cited by examiner

ANTENNA ASSEMBLIES AND METHODS OF MANUFACTURING THE SAME

CROSS-REFERENCE TO RELATED APPLICATION

This application claims the benefit and priority of U.S. Provisional Application No. 61/906,518 filed Nov. 20, 2013. The entire disclosure of the above application is incorporated herein by reference.

FIELD

The present disclosure generally relates to antenna assemblies and methods of manufacturing the same.

BACKGROUND

This section provides background information related to the present disclosure which is not necessarily prior art.

Two way radios and other portable communication devices may include external antennas that are oftentimes subjected to external impact and/or bending forces. The antenna must have sufficient strength to resist the external forces and be able to withstand and pass drop and bend testing. This can make designing a single antenna with multiband capabilities very challenging, especially as the internal structure and components become more complex but the design specifications do not allow increased antenna size (e.g., no increase in the outer diameter or total length). Also, a matching network may be used to broaden the VHF bandwidth, which matching network may typically be located inside the antenna assembly thus complicating the manufacturing process for the antenna assembly.

SUMMARY

This section provides a general summary of the disclosure, and is not a comprehensive disclosure of its full scope or all of its features.

According to various aspects, exemplary embodiments are disclosed of antenna assemblies and methods of manufacturing the same. In an exemplary embodiment, a method generally includes forming (e.g., molding, etc.) a sleeve over and/or between a first portion of a first component (e.g., a bushing, etc.) and a second portion of a second component (e.g., adaptor, etc.). The sleeve is coupled to the first and second portions of the respective first and second components. The method may also include removably attaching an antenna connector subassembly to the first component such that a printed circuit board assembly of the antenna connector subassembly is covered by the sleeve. The method may additionally include overmolding a sheath over the sleeve and one or more radiating elements of a multiband antenna assembly that includes the antenna connector subassembly, whereby the sleeve covers and protects the printed circuit board assembly during the overmolding.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 11:
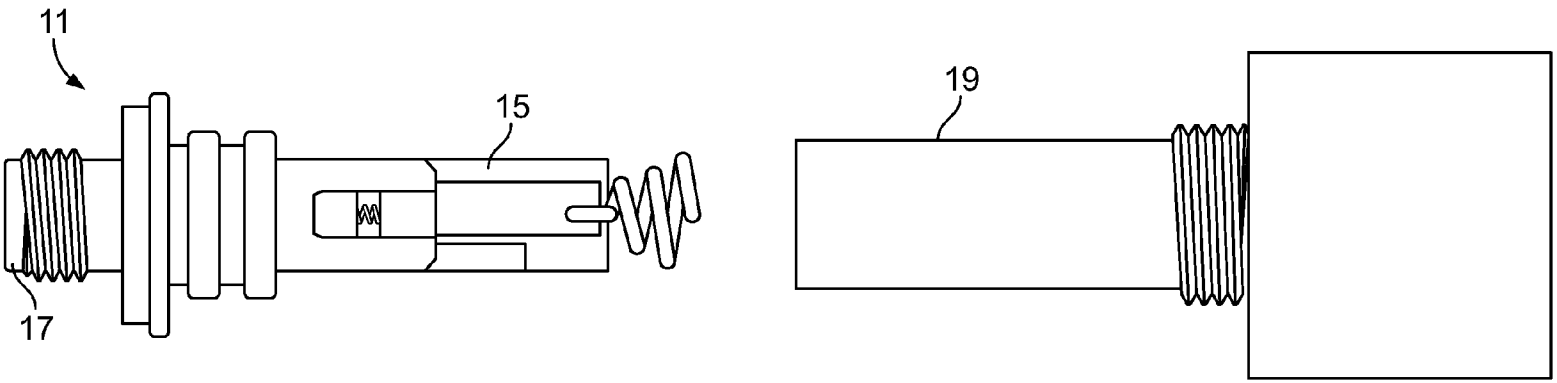
FIG. 11 (Prior Art)
FIG. 11 illustrates an antenna connector subassembly aligned with a tooling spool that may be used during a conventional injection molding method to overmold a sleeve over the printed circuit board assembly (PCBA) and connector of the antenna connector subassembly.
Figure 12:
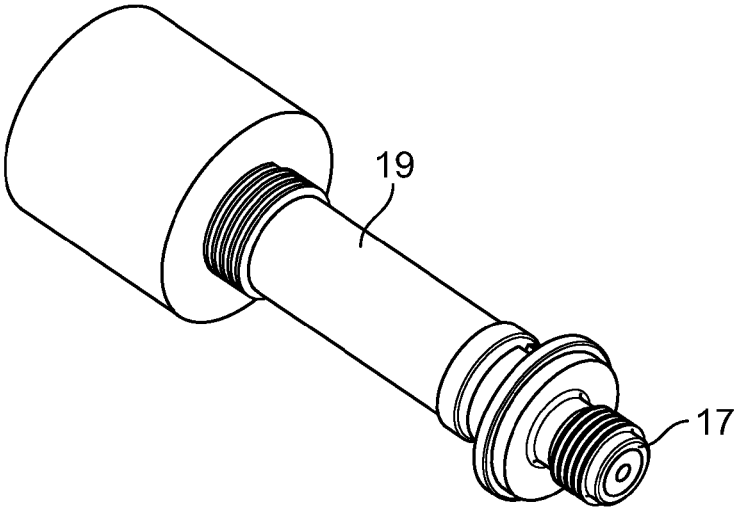
FIG. 12 (Prior Art)
Figure 13:
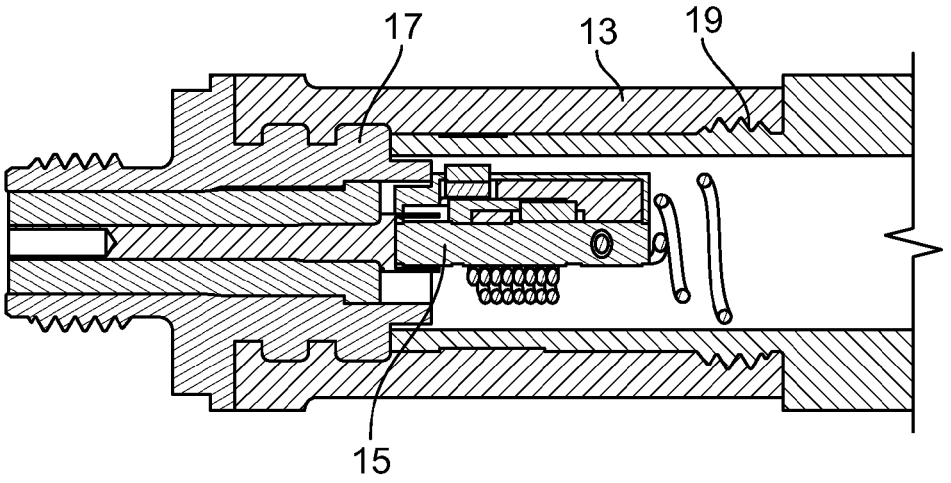
FIG. 13 (Prior Art)

FIG. 12 illustrates the antenna connector subassembly and tooling spool shown in FIG. 11 after the tooling spool has been positioned over the printed circuit board assembly (PCBA) prior to injection molding; and FIG. 13 is a cross-sectional view showing the sleeve formed via injection molding before the conventional tooling spool shown in FIGS. 11 and 12 is removed from the antenna connector subassembly.

Corresponding reference numerals indicate corresponding parts throughout the several views of the drawings.

DETAILED DESCRIPTION

Example embodiments will now be described more fully with reference to the accompanying drawings.

Portable communication devices may include external antennas that must have sufficient strength to resist external forces and be able to withstand and pass drop and bend testing. With such devices, a matching network may be used to broaden the VHF bandwidth, which matching network may typically be located inside the antenna assembly.

Conventionally, a sleeve is typically used to protect the printed circuit board having the matching network from the overmolding process used to create the sheath or radome of the antenna assembly. But the inventors hereof have recognized that the sleeve may be easily damage when it is too thin, and thus it is preferable to have a thicker sleeve (e.g., as thick as possible, etc.).

With a conventional method, sleeve wall thickness may be limited by the tooling and outer diameter antenna requirements. For example, increased sleeve wall thickness inward may be prohibited because of the spool used during injection molding of the sleeve in the conventional method. For example, FIGS. 11, 12 and 13 relate to a conventional injection molding method for providing a connector subassembly 11 with a sleeve 13 (FIG. 13) that is overmolded over a printed circuit board assembly (PCBA) 15 and connector 17 of the antenna connector subassembly 11. This conventional method generally includes positioning a tooling spool 19 generally over the PCBA 15 as shown by FIGS. 11 and 12. The sleeve 13 is then molded over the spool 19 and connector subassembly 11 as shown by FIG. 13. The spool 19 is removed while being rotated to thereby form threads inside the sleeve 13. In this conventional method, the sleeve wall thickness may be increased inwardly by reducing the tooling spool's wall thickness. But if the tooling spool wall thickness becomes too thin, then the tooling spool may become too susceptible to wear and break off during the injection molding due to high pressures. While this conventional manufacturing process may be satisfactory for its intended purpose, the inventors hereof have recognized the possibility for improvement as disclosed herein in terms of different designs, processes, and/or materials.

In an exemplary embodiment, a method generally includes placing first and second components in a tooling insert of a mold prior to injection molding the sleeve over and between portions of the first and second components. In this example, the first component comprise an electrically-conductive bushing (e.g., threaded metal bushing, etc.), and the second component comprises an electrically-conductive adaptor. Alternative embodiments may include other suitable components, such as other mechanical fasteners (e.g., threaded nuts, etc.), connectors, etc.

A portion of a helical radiating element or radiator may be wound or disposed around an upper portion of the adaptor and make metal contact to the adaptor, such as, for example, by means of soldering. The sleeve material (e.g., molten plastic, other suitable molding material, etc.) is injected into the mold such that the sleeve is injection molded over the bushing and a lower portion of the adaptor. Upon cooling, portions of the sleeve are disposed around and coupled (e.g., bonded or interlocked, etc.) to corresponding portions of the bushing and the adaptor.

A bonding agent (e.g., Loctite threadlocker, other suitable adhesive, etc.) may be applied to the threads of the bushing and/or the threads of a connector (e.g., 50 ohm connector, etc.) of an antenna connector subassembly. The antenna connector subassembly may also include an insulator, a contact, and a printed circuit board assembly (PCBA) having a matching network. The connector may be threaded into or threadedly engaged with the bushing, to thereby removably attach the antenna connector subassembly to the bushing, sleeve, and adaptor. Accordingly, the PCBA may thus be removed from the sleeve (e.g., for returning, modification, study, etc.) by unthreading the connector from the bushing.

The exemplary methods disclosed herein may be used with a wide range of antenna assemblies including the exemplary embodiments of multiband antenna assemblies disclosed herein (e.g., multiband antenna assembly 100 shown in FIGS. 1 through 4, etc.). Accordingly, the methods disclosed herein should not be limited to any one particular antenna configuration. By way of example, a method disclosed herein may be used for a multiband antenna assembly having a design generally based on a monopole concept with multiple radiators or radiating elements. The radiating elements may comprise one or more suspended conducting wires and helical radiating elements that will be coupled to a bottom matching network with one adaptor. A bottom suspended radiating element may be coupled to a dielectric coil form and spacer to prevent direct galvanic contact between the bottom suspended radiating element and a helical radiating element. The antenna assembly may be terminated with a connector (e.g., 50 Ohm connector, etc.) for connecting the antenna assembly to a device such that the antenna assembly depends to a ground plane of the device to excite.

With reference now to the figures, FIGS. 1 through 4 illustrate an exemplary embodiment of a multiband antenna assembly 100 embodying one or more aspects of the present disclosure. This exemplary embodiment has a design generally based on a monopole concept with multiple radiating elements.

Figure 1:
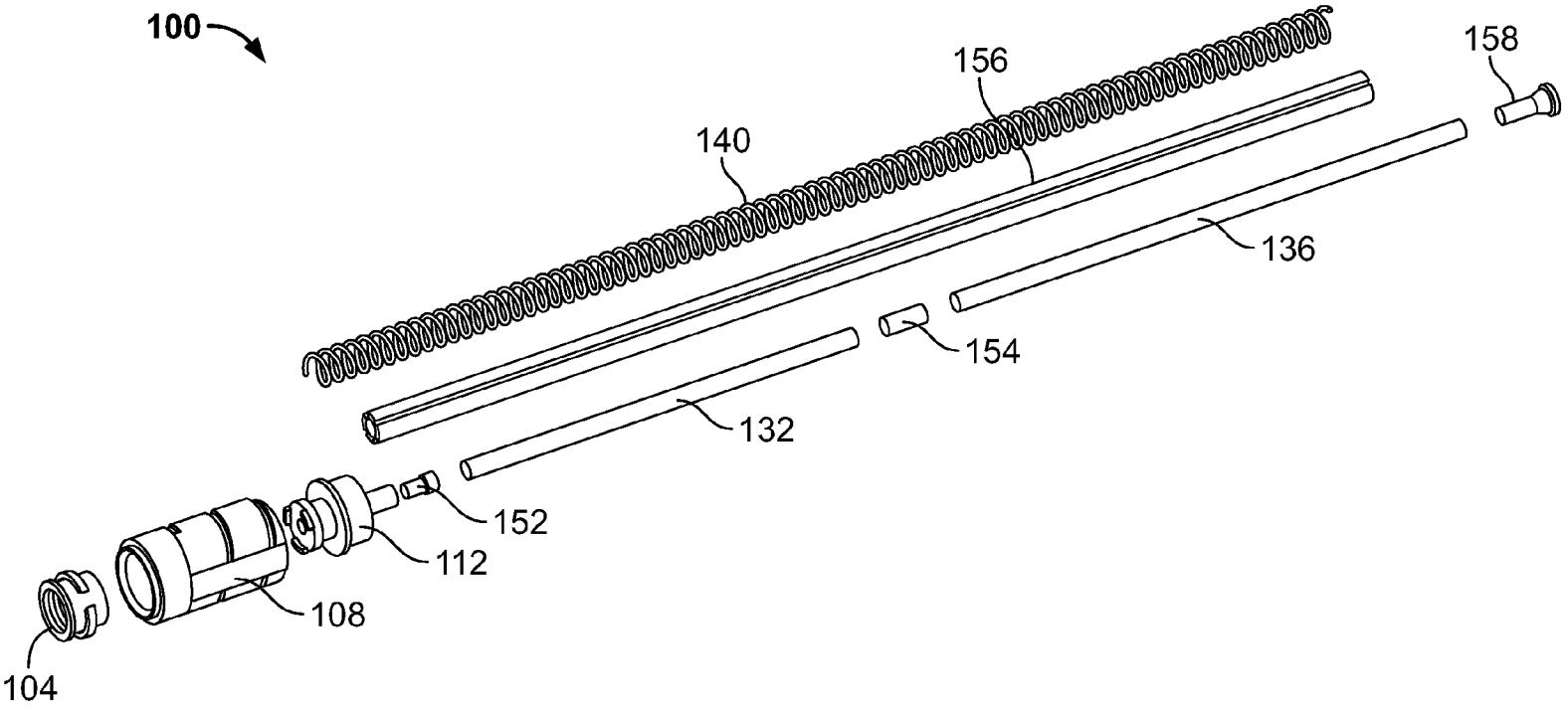
FIG. 1 is an exploded perspective view of a components of a multiband antenna assembly according to an exemplary embodiment.
Figure 2:
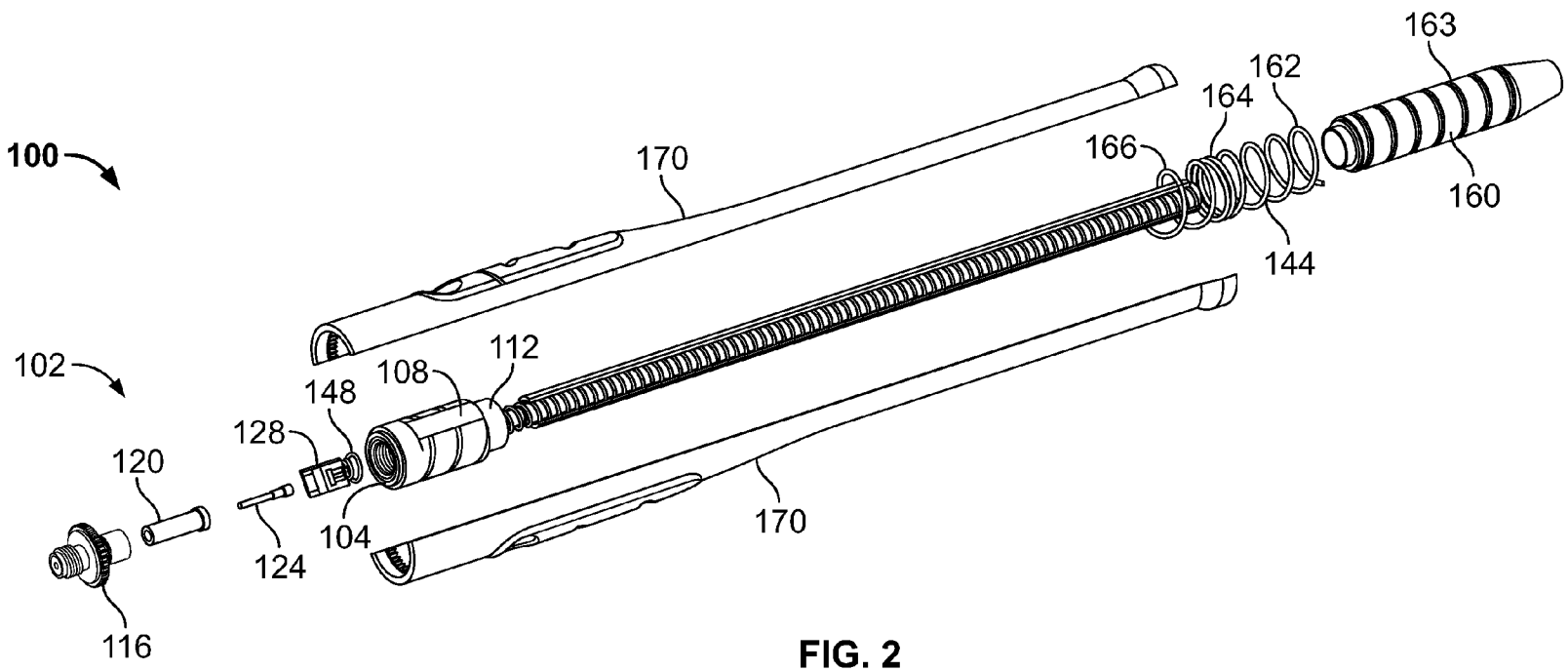
FIG. 2 is a perspective view of the components shown in FIG. 1 assembled together, and also showing additional components of the multiband antenna assembly according to an exemplary embodiment.
Figure 4:
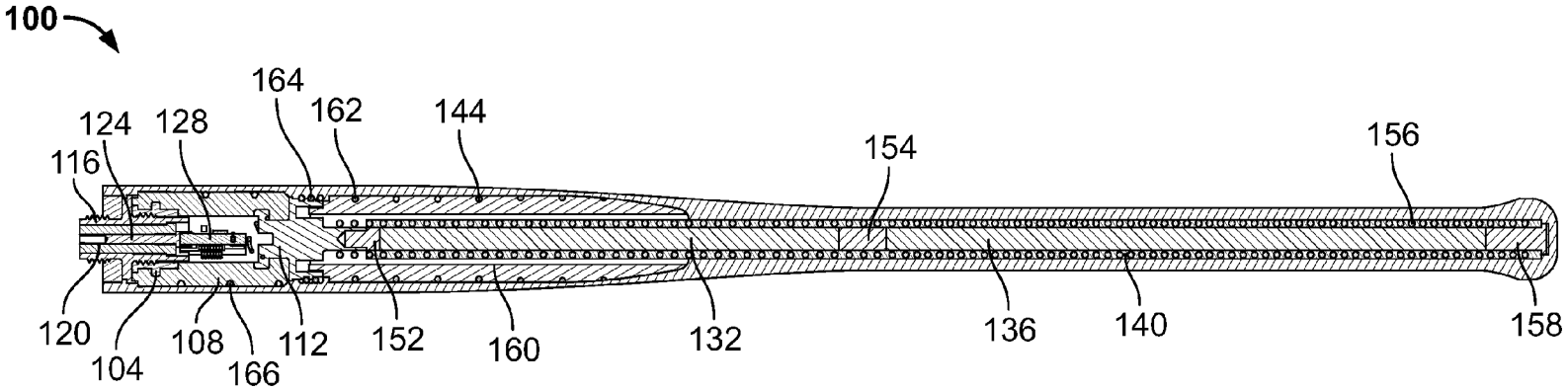
FIG. 4 is a cross-sectional view of the multiband antenna assembly along line 4-4 in FIG. 3.

As shown in FIG. 1, the multiband antenna assembly 100 includes a bushing 104 (broadly, a first component), a sleeve 108, and an adaptor 112 (broadly, a second component). The multiband antenna assembly 100 further includes a connector subassembly 102, which generally includes a connector 116, an insulator 120, a contact 124, and a printed circuit board assembly (PCBA) 128 as shown in FIGS. 2 and 4.

The sleeve 108 fits over the PCBA 128 and extends from connector 116 to the adaptor 112. In this example embodiment, the sleeve 108 comprises a generally cylindrical tubular housing or member. Alternative embodiments may include a differently configured sleeve and/or differently configured first and second components.

Figure 7:
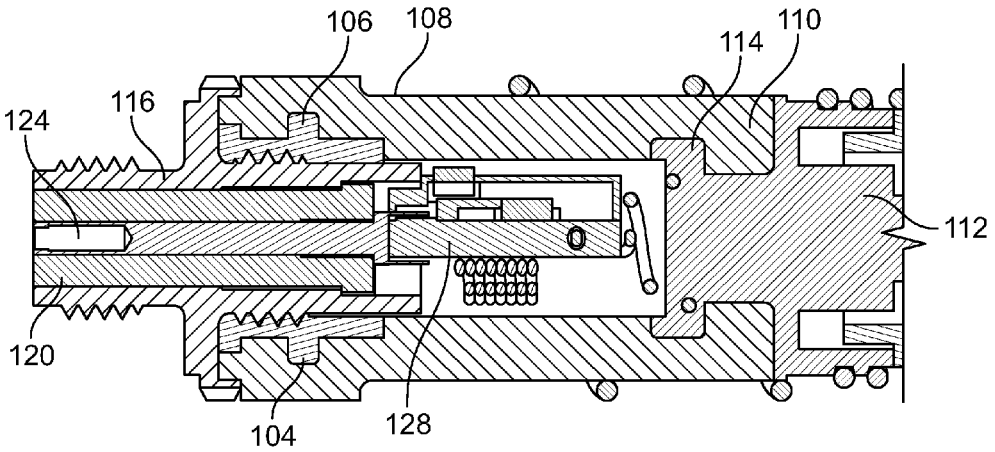
FIG. 7 is a cross-sectional view along line 7-7 in FIG. 6.
Figure 8:
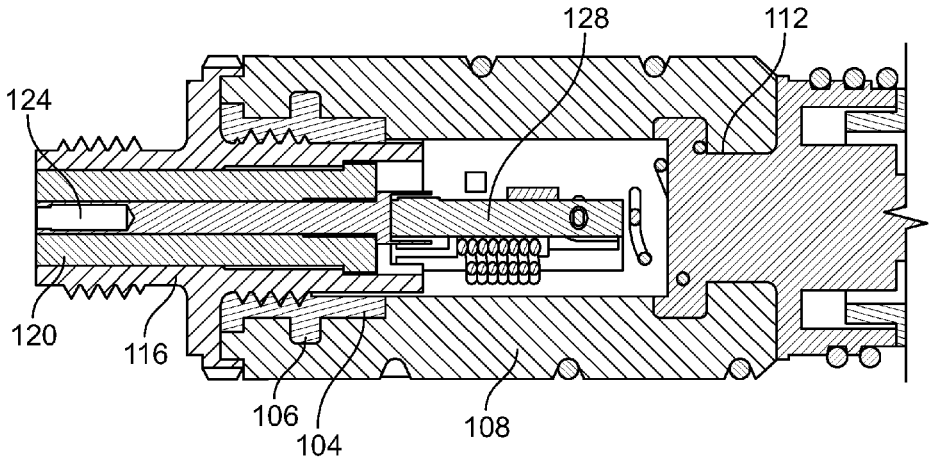
FIG. 8 is a cross-sectional view along line 8-8 in FIG. 6.

To make the sleeve 108, the bushing 104 and adaptor 112 are placed in a tooling insert of a mold prior to injection molding the sleeve 108. The sleeve material (e.g., molten plastic, etc.) is then injected into the mold, whereby the sleeve 108 is overmolded onto or molded over portions 106, 114 of the bushing 104 and adaptor 112, respectively. Upon cooling, the sleeve 108 is thus overmolded, disposed around, and interlocked with the respective portions 106, 114 of the bushing 104 and adaptor 112 as shown in FIGS. 7 and 8. The portions 106, 114 generally comprise outwardly extending or protruding (e.g., radially projecting, etc.) sleeve resisting portions that are collectively operable to resist movement of the sleeve 108 between or relative to the bushing 104 and adaptor 112. The sleeve 108 is fixedly attached, secured, bonded, or interlocked to the bushing 104 and adapter 112. Also, the bond created by the portion 110 of the sleeve 108 overmolded and interlocked with the portion 114 of the adapter 112 is stronger with enhanced material gripping and able to withstand much higher impact forces (e.g., robust enough to withstand mechanical impact testing, etc.) as compared to a conventional threaded connection.

A bonding agent (e.g., Loctite threadlocker, other suitable adhesive, etc.) may be applied to the threads of the bushing 104 and/or the threads of the connector 116. The connector 116 is threaded into or threadedly engaged with the bushing 104, to thereby removably attach the antenna connector subassembly 102 to the bushing 104, sleeve 108, and adaptor 112. Accordingly, the PCBA 128 may thus be removed from the sleeve 108 (e.g., for returning, modification, study, etc.) by unthreading the connector 116 from the bushing 104.

The sleeve 108 and adaptor 112 helps to reduce the impact to the PCBA 128 if the antenna assembly 100 is dropped as the adaptor 112 helps transfer loads or impact forces to the sleeve 108. The PCBA 128 may thus be protected from damage that might otherwise occur when the antenna assembly 100 is dropped.

With continued reference to FIGS. 1 through 4, the antenna assembly 100 also includes linear and helical radiators or radiating elements 132, 136, 140, and 144 coupled to a matching network of the PCBA 128 via the adaptor 112 and a contact spring 148. In this example, the linear radiators 132, 136 are located or suspended generally inside the helical radiators 140, 144. The linear radiators 132, 136 extend along and/or are aligned generally with the central longitudinal axes of the helixes of the helical radiators 140, 144. Alternative embodiments may include other antenna arrangements than what is shown in the figures, such as only linear radiators, only helical radiators, more or less linear and/or helical radiators, etc.

FIG. 1 illustrates the first and second dielectric spacers or insulators 152, 154 for mechanically coupling (e.g., affixes, attaches, etc.) the first and second linear radiators 132, 136 to the adapter 112 and to each other. The first spacer 152 mechanically couples the first linear radiator 132 to the adapter 112. The second spacer 154 mechanically couples end portions of the first and second linear radiators 132, 136 together. In addition, the spacers 152, 154 are configured to prevent the first and second linear radiators 132, 136 from making direct galvanic contact with each other and from making direct galvanic contact with the helical radiators 140, 144. The use of the first and second linear radiators 132, 136 and spacers 152, 154 may allow the antenna assembly 100 to use a relatively small diameter helical radiator 140, which, in turn, may allow the antenna assembly 100 to be more flexible with a relatively thin profile.

The linear radiators 132, 136 may be disposed within a coil form 156 (e.g., insert molded coil form, etc.) as shown in FIG. 4. The helical radiator 140 is disposed about the exterior of the coil form 156 such that the linear radiators 132, 136 do not make direct galvanic contact with the helical radiator 140. A dielectric end cap 158 is positioned or coupled to the end of the coil form 156.

Figure 5:
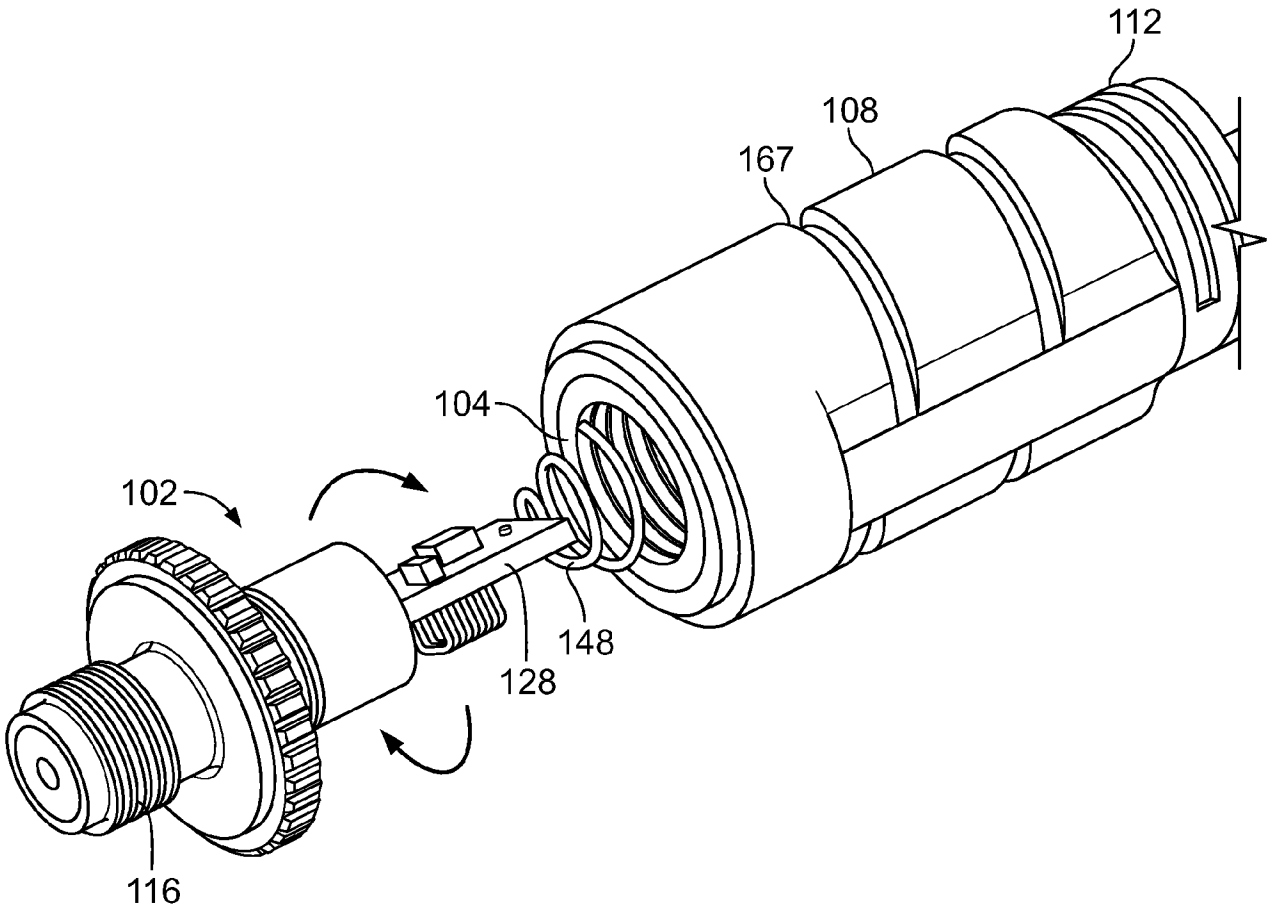
FIG. 5 is a perspective view illustrating the exemplary manner by which the antenna connector subassembly and the bushing of the multiband antenna assembly shown in FIG. 2 may be threadedly engaged, where the antenna connector subassembly includes a printed circuit board assembly (PCBA) and a connector for connecting the multiband antenna assembly to a device housing.
Figure 6:
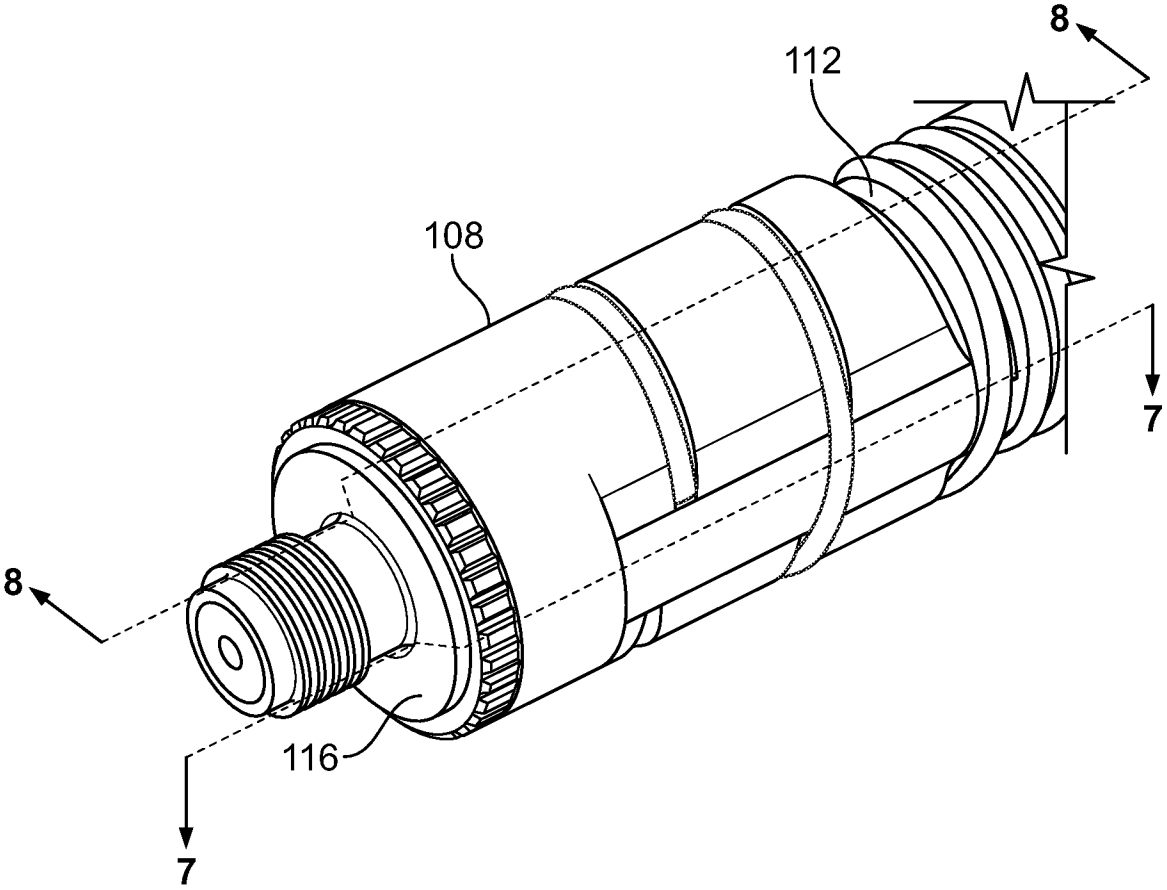
FIG. 6 is a perspective view of a portion of the multiband antenna assembly shown in FIG. 5 after the antenna connector subassembly is threadedly engaged to the bushing, and also showing the second helical radiating element coupled to portions of the sleeve and adaptor.

As shown in FIG. 4, the second helical radiator 144 also includes first, second, and third portions 162, 164, 166 respectively disposed about a second coil form 160, the adapter 112, and the sleeve 108. More specifically, the first portion 162 of the second helical radiator 144 is disposed within grooves 163 (FIG. 2) about the exterior of the second coil form 160. The second portion 164 of the second helical radiator 144 is in direct galvanic contact with the upper portion of the adapter 112. The third portion 166 of the second helical radiator 144 is disposed within grooves 167 (FIGS. 5 and 6) about the exterior of the sleeve 108. The linear radiators 132, 136 and first helical radiator 140 may be configured such that they do not make direct galvanic contact with each other or with the second helical radiator 144. In operation, the helical radiators 140, 144 may parasitically couple to the linear radiators 132, 136 and to each other.

Figure 3:
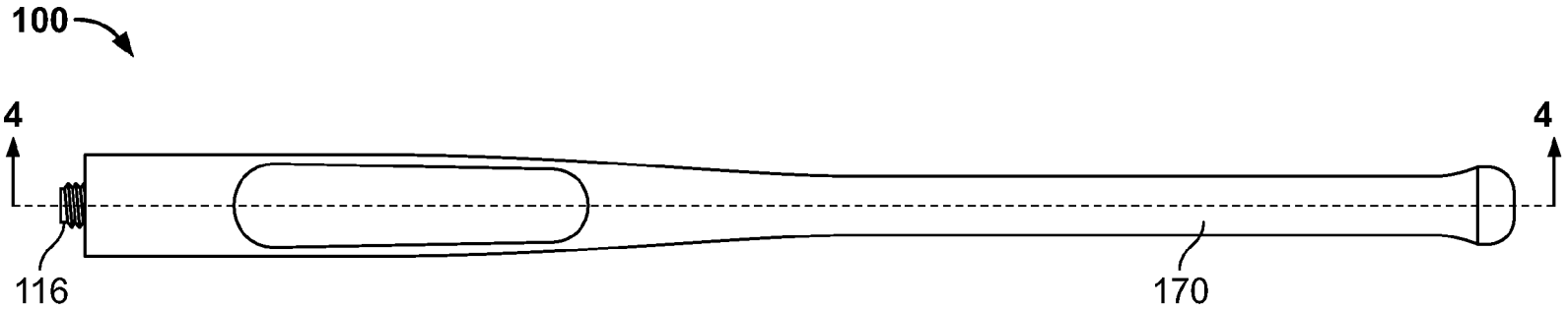
FIG. 3 illustrates the multiband antenna assembly shown in FIG. 2 after being fully assembled.

The antenna assembly 100 also includes a sheath or radome 170. As shown in FIGS. 3 and 4, the components of the antenna assembly 100 are contained within or under the sheath or radome 170 except for the threaded portion of the connector 116 that is external to and protrudes outwardly from the sheath 170. The threaded portion of the connector 116 may be used for connecting the antenna assembly 100 to a device. When connected to a device, the antenna assembly 100 may depend to a ground plane of the device to excite. Also, the antenna assembly 100 may be threadedly connected to a device housing such that the bulk of the antenna assembly or unit 100 is external to the device housing. For example, the PCBA 128, contact spring 148, radiating elements 132, 136, 140, 144, coil forms 156, 160, spacers 152, 154, and end cap 158 are able to be entirely contained within or under the sheath 170 and remain external to the device housing. Thus, the antenna assembly 100 is able to provide multiband operation (e.g., in the VHF, UHF, 7/800, and GPS frequency bands, etc.) without having to significantly increase the overall size or volume of a device housing.

By way of example only, the sheath 170 may have a length of about 200 millimeters and a diameter of about 14.5 millimeters along the portion disposed over the connector 116. The sheath 170 may be formed by an overmolding process during which the sleeve 108 protects the PCBA 128 and matching network thereof.

The contact spring 148 may include a hook portion (e.g., J-shaped or L-shaped hook portion, etc.) that extends through an opening or hole in the circuit board of the PCBA 128. The hook portion may terminate in a protrusion to provide additional resistance to pull through force tending to cause the hook portion to pull out of the hole in the circuit board. The hook portion may be sized to fit in and through the hole in the circuit board to provide a mechanical connection between the circuit board and the adapter 112. For example, the coils of the spring contact 148 may be wrapped or wound about a lower portion of the adapter 112.

Electrical connection may be made by various means to connect conductive traces on the circuit board with the spring contact 148, such as by soldering, a press fit connection, a stamped metal connection, etc. In this example embodiment, the contact spring 148 is shown as a separate component, but in other embodiments the contact spring 148 may comprise an integral piece or extension of a helical radiating element 140 or 144.

The insulator 120 electrically insulates the contact 124 (e.g., contact pin, etc.) from the connector 116. The contact 124 may be electrically coupled or connected to the PCBA 128, which, in turn, is electrically coupled or connected to the adaptor 112. Radio frequency power from a device (e.g., two-way radio, etc.) may be provided to the antenna assembly 100 by the contact 124 through the PCBA 128 when the antenna assembly 100 is threadedly connected to the device housing. The contact 124 may be coupled to the PCBA 128, such as by a soldered connection, a press fit connection, a snap fit connection, a crimp connection, etc. The PCBA 128 may be coupled to the adaptor 112 via the contact spring 148. Accordingly, the contact 124 may thus provide radio frequency power through the PCBA 128, spring contact 148, and adaptor 112.

In exemplary embodiments, the linear radiators 132, 136 may comprise flexible electrically conducting wires or cables. Examples of electrically conductive wires or cables that may be used as the linear radiators 132, 136 include a speedometer cable, nickel titanium (NiTi) wire, among other suitable cables or wires. Other electrically conductive materials and/or configurations may also be used for the linear radiators 132, 136.

A wide range of electrically conducting materials, preferably highly conductive materials, may be used for the helical radiators 140, 144. By way of example, the helical radiators 140, 144 may be formed from copper wire, spring wire, copper/tin/nickel plating wire, enameled wire, among other materials that may be configured to have the helical/spring configuration. In addition, the coils of the helical radiators 140, 144 are configured (e.g., single pitch, multiple pitch, spacing, size, shape, etc.) in this example embodiment for the specific frequency bands disclosed herein. Alternative embodiments may be configured for use with additional and/or different frequencies such as by varying the windings of the helical radiator coils. For example, other embodiments may include one or more helical radiators having coils with a constant pitch, two or more different pitches and/or with a tapering pitch such that the coil has an upper or lower section wider than the other section.

The matching network of the antenna assembly 100 may comprise lumped components residing on front and back oppositely facing surfaces of the printed circuit board assembly 128. The matching network is part of the antenna assembly 100 rather than the device to which the antenna assembly 100 will be connected. Accordingly, the antenna assembly 100 does not have to rely upon a matching network that is part of or internal to the device as the antenna assembly 100 instead includes its own (e.g., embedded, etc.) matching network. Placing the PCBA 128 and its matching network in the antenna assembly 100 and external to the device housing allows more volume in the device for other components, such as for increased circuitry to further enhance performance of the device.

The matching network may comprise one or more shunt or series capacitors and/or one or more shunt or series inductors depending on the matching network topology. For example, the matching network circuit board may comprise, for example, a two-element L shaped network of a capacitor and shunt inductor. Additionally, or alternatively, the circuit board may also include other capacitors, inductors, resistors, or the like, as well as conductive traces. In operation, the matching network may provide broadband impedance matching by generally providing a 50 ohm load across the operating frequencies of interest. The PCBA 128 and lumped components thereof that provide the impedance matching of the matching network may be configured such that they will be contained within or under a sheath or radome as shown in FIGS. 2 and 4.

In this particular example, the connector 116 includes a first threaded portion for threaded connection to the bushing 104 and a second threaded portion for threaded connection to a device housing. The antenna assembly 100 may be threadedly connected to a device housing such that the bulk of the antenna assembly or unit 100 is external to the device housing. That is, the radiating elements 132, 136, 140, 144 and circuit board having the matching network of the antenna assembly 100 are able to be entirely contained within or under the sheath 170 and remain external to the device housing. Thus, the antenna assembly 100 is able to provide multiband operation in the VHF, UHF, 7-800, and GPS frequency bands without having to significantly increase the overall size or volume of the device housing.

Figure 9:
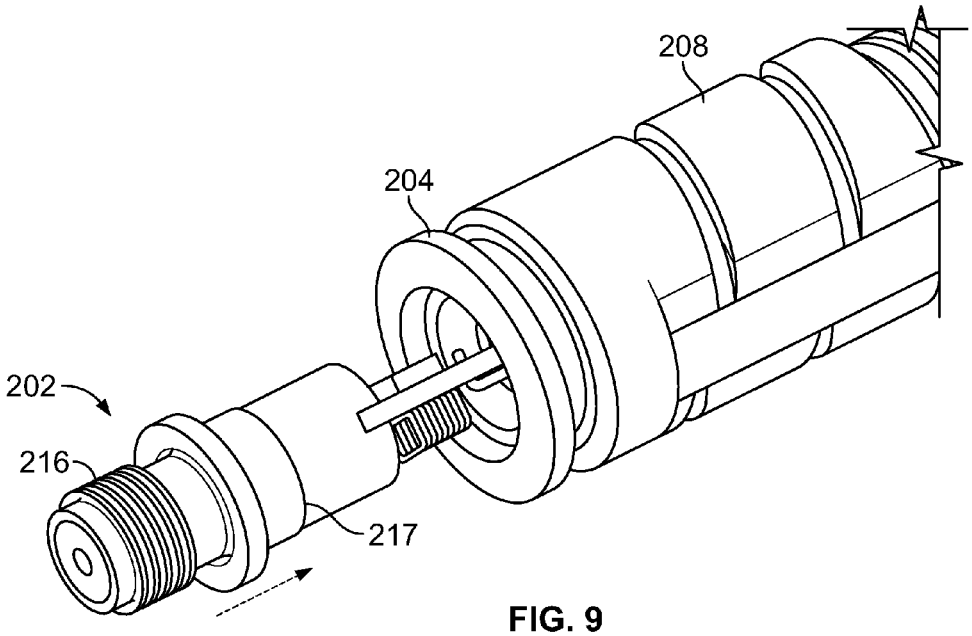
FIG. 9 is a perspective view illustrating an alternative embodiment where the antenna connector subassembly and bushing having a press-in or press fit configuration such that the antenna connector subassembly may be pressed into the bushing.

Alternative embodiments may include differently configured connector subassemblies, e.g., with different connector types, different PCBA layouts, different adaptor and bushing configurations, etc. For example, the antenna assembly 100 includes the electrically-conductive (e.g., metal, etc.) threaded bushing 104. But other exemplary embodiments other suitable first and second components, such as other mechanical fasteners (e.g., threaded nuts, etc.), adaptors, connectors, etc. For example, FIG. 9 illustrates an alternative embodiment that includes an antenna connector subassembly 202 having a press-in or press fit configuration. In this example, the antenna connector subassembly 202 may be pressed (e.g., using a jib, etc.) into a bushing 204. The bushing 204 is secured to a sleeve 208. The connector 216 includes a shoulder portion 217 larger (e.g., greater diameter than, etc.) than the opening in the bushing 204 to create an interference or friction.

Figure 10:
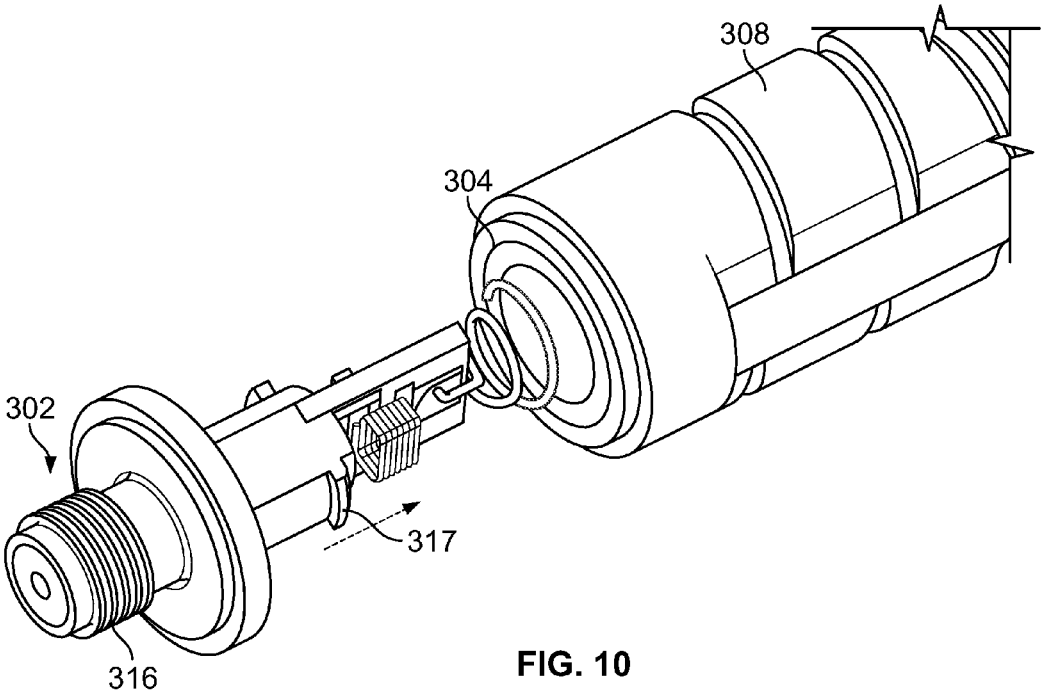
FIG. 10 is a perspective view illustrating another alternative embodiment where the antenna connector subassembly and bushing having a snap-fit configuration such that the antenna connector subassembly may be pressed and snapped into the bushing.

As another example, FIG. 10 illustrates an alternative embodiment that includes an antenna connector subassembly 302 having a snap-fit configuration. In this example, the antenna connector subassembly 302 may be pressed (e.g., using a jib, etc.) and snapped into a bushing 304. The bushing 304 is secured to a sleeve 308. The connector 316 includes protruding portions or latches 317 configured to be snapped into corresponding openings of the bushing 304.

The antenna assembly 100 may be configured to be operable or to cover multiple frequency ranges or bands, including the VHF frequency band from about 136 MHz to about 174 MHz, the UHF frequency band from about 380 MHz to about 527 MHz, the 7-800 MHz frequency band from about 764 MHz to about 870 MHz, and the GPS frequency of 1575 MHz. The matching network of the PCBA 128 is operable to help broaden the bandwidth of the VHF band for resonance from 136 MHz to 174 MHz. Accordingly, the antenna assembly 100 may be configured for at least quad band operation in this example. Alternative embodiments may be configured to be operable in different or additional frequency bands.

The helical radiators 140, 144 may comprise single pitch helical coil radiators, or multiple (e.g., dual pitch, etc.) helical coil radiators or springs having narrower and wider pitch coils along their respective lower and upper portions. In this example, the helical radiating element 140 corresponds to the VHF band. The total electrical length of the helical radiator 140 and the adaptor 112 may be about one quarter wavelength ($\lambda/4$) for the VHF band.

Adding the second helical radiating element 144 at the bottom of the antenna assembly 100 allows the antenna assembly 100 to operate at UHF, 7-800 MHz, and GPS bands. The second helical radiator 144 is wound or disposed around a portion of the adaptor 112, and makes metal contact to the adaptor 112, such as, for example, by means of soldering. The second helical radiator 144 may have narrow or close pitch coils to correspond to the UHF and 7-800 MHz bands and wide or loose pitch coils to correspond to the 7-800 MHz and GPS bands. Proper tuning at/of close pitch coils of the bottom helical radiating element 144 will help to broaden the bandwidth of the 7-800 MHz band with its second harmonic resonance at 7-800 MHz. Wide or loose pitch coils of the bottom helical radiating element 144 may be used to create another resonance at the GPS band with its second harmonic resonance frequency. The coils of the bottom helical radiator 144 may be configured in various ways.

In this example, the first linear radiator 132 (e.g., bottom suspended wire, etc.) is at least partially inside the helical radiating element 140. The spacer/insulator 152 is between and separates the adaptor 112 and first linear radiator 132. With this configuration, the bottom helical radiating element 144 parasitically couples to the linear radiator 132. Indirectly, this coupling helps to shift the UHF and 7-800 MHz bands to lower frequencies and broadens the bandwidth for the 7-800 MHz band. The electrical length of the linear radiator 132 may be about one quarter wavelength ($\lambda/4$) for the 7-800 MHz band. With the parasitic coupling, the combined electrical length of the linear radiator 132 and coils of the bottom helical radiating element 144 may be about three quarter wavelength ($3\lambda/4$) for the 7-800 MHz frequency band.

The second linear radiator 136 (e.g., top suspended wire, etc.) is above the first linear radiator 132 (e.g., bottom suspended wire, etc.). The spacer/insulator 154 is between and separates the first and second linear radiators 132, 136. This configuration indirectly creates a parasitic coupling between the first and second linear radiators 132, 136. Indirectly, this coupling may increase the electrical length of the first or bottom linear radiator 132 to one quarter wavelength (λ/4) for the UHF band. The increased wavelength helps to improve the bandwidth of the UHF band of the antenna assembly 100. Accordingly, multiple wavelengths are introduced by the linear and helical radiators 132, 136, 140, and 144, including the VHF, UHF, 7-800 MHz, and GPS bands. Also, the coupling of these radiators 132, 136, 140, and 144 allows the antenna assembly 100 to have an omnidirectional radiation pattern across the VHF, UHF, and 7-800 MHz frequency bands.

Exemplary embodiments of multiband antenna assemblies and methods of manufacturing antenna assemblies are disclosed that may provide one or more (but not necessarily any or all) of the following advantages. These advantages may be related to mechanical advantages, radio frequency (RF) performance advantages, and/or manufacturing advantages.

From the mechanical point of view, exemplary embodiments may allow for an increased (or maximized) sleeve wall thickness, such as an additional 0.75 mm per side inward. An increased sleeve wall thickness will strengthen the sleeve significantly without affecting or requiring an increased outer diameter of the antenna assembly as the increased wall thickness is provided inwardly. Typically, the outer diameter of the antenna assembly is a design requirement set or fixed by the customer, such that the outer diameter may not be increased. The sleeve wall thickness may not be uniform or constant, such that the sleeve wall thickness at one location may be different than the sleeve wall thickness at a different location along the sleeve circumference. By way of example, the total sleeve wall thickness may be 2.5 millimeters (or thereabout) for the portion of the sleeve shown in FIG. 7, which is a cross-sectional view along line 7-7 in FIG. 6. As another example, the total sleeve wall thickness may be 3.3 millimeters (or thereabout) for the portion of the sleeve shown in FIG. 8, which is a cross-sectional view along line 8-8 in FIG. 6.

In exemplary embodiments, the sleeve and adapter are bonded via the insert molding process during which a portion of the sleeve is overmolded or disposed around and bonded to a portion of the adaptor. As compared to a threaded connection, the bond created by the insert molding process is stronger with enhanced material gripping and able to withstand much higher impact forces (e.g., robust enough to withstand mechanical impact testing, etc.).

In exemplary embodiments, the sleeve having the increased sleeve wall thickness is able to withstand higher temperatures and pressure during the overmolding process used to create the sheath or radome. This allows a wider range of materials to be selected for the sleeve including materials without glass reinforcement. For example, a material (e.g., polycarbonates (PC), etc.) may be used in exemplary embodiments that is not glass reinforced grade and/or that is less brittle than some existing glass reinforced materials (e.g., 45% glass reinforced grade polyphthalamide (PPA), etc.). A brittle material may tend to cause failure after mechanical impact test. And, using a less brittle material will allow the antenna assembly to withstand much higher impact forces.

In addition to the possible mechanical advantages noted above, exemplary embodiments may also or instead provide one or more advantage(s) from the RF point of view. For example, the printed circuit board assembly (PCBA) is removable from the sleeve without damaging the PCBA as the PCBA is part of the antenna connector subassembly that is removably attached to the bushing. Because the PCBA is removable from the sleeve, it is more convenient to retune, modify, replace, and/or study the PCBA matching circuit without affecting or damaging the radiating elements and mechanical structure of the antenna assembly.

As noted above, a wide range of materials may be used for the sleeve including materials without glass reinforcement as the increased sleeve wall thickness can withstand higher temperatures and pressure during the overmolding process to create the sheath or radome. This means that if a particular material selected for the sleeve is a contributor to RF performance failure then a different material may be tested and used for the sleeve.

Exemplary embodiments may also or instead provide one or more advantages from the manufacturing point of view. As noted above, the printed circuit board assembly (PCBA) is removable from the sleeve in exemplary embodiments as the PCBA is part of the antenna connector subassembly that is removably attached (e.g., threaded, press fit, snap fit, etc.) to the bushing. The handling rejection for the PCBA when placing it to a molding machine is avoided during the process of molding the sleeve as the PCBA is split out from the sleeve injection molding process. In addition, exemplary embodiments may also allow for a more consistent manufacturing process and/or better yields.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method comprising:

forming a sleeve over or between a first portion of a first component and a second portion of a second component, such that the sleeve is coupled to the first and second portions of the respective first and second components; and removably attaching an antenna connector subassembly of a multiband antenna assembly to the first component such that a printed circuit board assembly of the antenna connector subassembly is covered by the sleeve;

wherein the multiband antenna assembly comprises one or more radiating elements including at least one helical radiator having a longitudinal axis, and at least one linear radiator aligned with or disposed at least partially along the longitudinal axis of the at least one helical radiator, whereby the antenna assembly is resonant in multiple frequency bands; and wherein:

the at least one linear radiator comprises first and second linear radiators;

the at least one helical radiator comprises first and second helical radiators;

a first dielectric spacer mechanically couples a first end portion of the first linear radiator to the second component;

a second dielectric spacer mechanically couples a second end portion of the first linear radiator to a first end portion of the second linear radiator;

a first coil form is disposed over the first and second linear radiators and supports at least a portion of the first helical radiator; and a second coil form is disposed over the first coil form and supports at least a portion of the second helical radiator;

the first and second linear radiators are not galvanically coupled to each other; and the first and second linear radiators extend through one or more coils of the first or second helical radiator without galvanically coupling to the first and second helical radiators.

2. The method of claim 1, further comprising overmolding a sheath over the sleeve and the one or more radiating elements of the multiband antenna assembly that includes the antenna connector subassembly, whereby the sleeve protects the printed circuit board assembly during the overmolding.

3. The method of claim 1, wherein forming a sleeve comprises insert injection molding.

4. The method of claim 1, wherein forming a sleeve comprises:

inserting the first and second components into a mold; and injecting material into the mold to thereby form the sleeve, whereby the sleeve is bonded to the first and second components.

5. The method of claim 1, wherein removably attaching the antenna connector subassembly to the first component comprising inserting the printed circuit board assembly through an opening in the first component into a hollow interior of the sleeve, whereby the printed circuit board assembly is removable from within the hollow interior of the sleeve without damage.

6. The method of claim 1, wherein removably attaching the antenna connector subassembly to the first component comprises threadedly engaging the antenna connector subassembly to the first component.

7. The method of claim 1:

wherein the first component comprises a bushing having a threaded opening;

wherein the antenna connector subassembly includes a connector electrically coupled with the printed circuit board assembly, the connector including:

a first threaded portion for threaded engagement with the threaded opening of the bushing; and a second threaded portion for threaded connection to a device housing;

wherein removably attaching the antenna connector subassembly to the first component comprises:

inserting the printed circuit board assembly through the threaded opening of the bushing into a hollow interior of the sleeve; and threadedly engaging the first threaded portion of the connector with the threaded opening of the bushing.

8. The method of claim 1, wherein the antenna connector subassembly is removably attachable to the first component by a threaded connection, a press fit connection, or a snap fit connection.

9. The method of claim 1:

wherein the first component comprises a bushing have an opening;

wherein the antenna connector subassembly includes a connector electrically coupled with the printed circuit board assembly, the connector including:

a first portion configured to be inserted into the opening of the bushing for removable attachment with the bushing; and a second portion for connection to a device housing;

wherein removably attaching the antenna connector subassembly to the first component includes:

inserting the printed circuit board assembly through the opening of the bushing into a hollow interior of the sleeve; and removably attaching the first portion of the connector with the bushing.

10. The method of claim 9:

wherein the second component comprises an adaptor;

a contact spring is electrically coupled to the printed circuit board assembly; and inserting the printed circuit board assembly through the opening of the bushing into the hollow interior of the sleeve includes electrically contacting the contact spring with the adaptor to thereby electrically couple the printed circuit board assembly with the adaptor via the contact spring.

11. The method of claim 10:

wherein forming a sleeve comprises:

inserting the bushing and the adaptor into a mold; and injecting material into the mold to thereby form the sleeve which is bonded to the bushing and the adaptor;

wherein the method further comprises:

coupling the adaptor to the one or more radiating elements of the multiband antenna assembly; and overmolding a sheath over the sleeve and the one or more radiating elements, whereby the sleeve protects the printed circuit board assembly during the overmolding.

12. A method comprising:

molding a sleeve over or between a bushing and an adaptor such that the sleeve is bonded to the bushing and the adaptor;

removably attaching an antenna connector subassembly to the bushing, which includes inserting a printed circuit board assembly of the antenna connector subassembly into a hollow interior of the sleeve; and overmolding a sheath over the sleeve and one or more radiating elements of a multiband antenna assembly that includes the antenna connector subassembly, whereby the sleeve covers and protects the printed circuit board assembly during the overmolding;

wherein the one or more radiating elements comprise:

at least one helical radiator having a longitudinal axis; and at least one linear radiator aligned with or disposed at least partially along the longitudinal axis of the at least one helical radiator;

whereby the antenna assembly is resonant in multiple frequency bands;

wherein:

the at least one linear radiator comprises first and second linear radiators;

the at least one helical radiator comprises first and second helical radiators;

a first dielectric spacer mechanically couples a first end portion of the first linear radiator to the adaptor;

a second dielectric spacer mechanically couples a second end portion of the first linear radiator to a first end portion of the second linear radiator;

a first coil form is disposed over the first and second linear radiators and supports at least a portion of the first helical radiator; and a second coil form is disposed over the first coil form and supports at least a portion of the second helical radiator;

the first and second linear radiators are not galvanically coupled to each other; and the first and second linear radiators extend through one or more coils of the first or second helical radiator without galvanically coupling to the first and second helical radiators.

13. The method of claim 12:

wherein the bushing includes an opening;

wherein a contact spring is electrically coupled to the printed circuit board assembly;

wherein the antenna connector subassembly includes a connector electrically coupled with the printed circuit board assembly, the connector including:

a first portion configured to be inserted into the opening of the bushing for removable attachment with the bushing; and a second portion for connection to a device housing;

wherein removably attaching the antenna connector subassembly to the bushing includes:

inserting the printed circuit board assembly through the opening of the bushing into the hollow interior of the sleeve, which includes electrically contacting the contact spring with the adaptor; and removably attaching the first portion of the connector with the bushing.

14. The method of claim 13:

wherein molding the sleeve comprises:

inserting the bushing and the adaptor into a mold; and injecting material into the mold to thereby form the sleeve; and wherein the method further comprising:

coupling the adaptor to the one or more radiating elements of the multiband antenna assembly prior to overmolding the sheath; and coupling the second portion of the connector to a device housing such that the multiband antenna assembly depends to a ground plane of the device to excite and such that the sheath, the sleeve, the bushing, the adaptor, the printed circuit board assembly, and the one or more radiating elements are external to the device housing.

15. An antenna assembly comprising a bushing having an opening;

an adaptor;

a sleeve disposed over or between portions of the bushing and the adaptor such that the sleeve is bonded to the bushing and the adaptor, the sleeve including a hollow interior;

an antenna connector subassembly removably attached to the bushing, the antenna connector subassembly including:

a printed circuit board assembly having a matching network, the printed circuit board assembly disposed within the hollow interior of the sleeve, whereby the printed circuit board assembly is removable from within the hollow interior of the sleeve through the opening in the bushing; and a connector electrically coupled with the printed circuit board assembly, the connector including a first portion configured to be inserted into the opening of the bushing and removably attached with the bushing, and a second portion for connection to a device housing;

one or more radiating elements coupled to the adaptor; and a sheath disposed over the sleeve and the one or more radiating elements;

wherein the one or more radiating elements comprise:

at least one helical radiator having a longitudinal axis; and at least one linear radiator aligned with or disposed at least partially along the longitudinal axis of the at least one helical radiator;

whereby the antenna assembly is resonant in multiple frequency bands;

wherein:

the at least one linear radiator comprises first and second linear radiators;

the at least one helical radiator comprises first and second helical radiators;

a first dielectric spacer mechanically couples a first end portion of the first linear radiator to the adaptor;

a second dielectric spacer mechanically couples a second end portion of the first linear radiator to a first end portion of the second linear radiator;

a first coil form is disposed over the first and second linear radiators and supports at least a portion of the first helical radiator; and a second coil form is disposed over the first coil form and supports at least a portion of the second helical radiator;

the first and second linear radiators are not galvanically coupled to each other; and the first and second linear radiators extend through one or more coils of the first or second helical radiator without galvanically coupling to the first and second helical radiators.

16. The antenna assembly of claim 15, wherein the antenna connector subassembly is removably attachable to the bushing by a threaded connection, a press fit connection, or a snap fit connection.

17. The antenna assembly of claim 15:

wherein the opening of the bushing is threaded;

wherein the first portion of the connector is threaded for threaded connection to the threaded opening of the bushing; and wherein the second portion of the connector is threaded for threaded connection to a device housing.

18. A device comprising a housing and the antenna assembly of claim 15 connected to the housing by the second portion of the connector, wherein the sheath, the one or more radiating elements, the printed circuit board assembly, the matching network, the sleeve, the adaptor, and the bushing are external to the housing of the device.

19. The antenna assembly of claim 15, wherein:

the at least one linear radiator is aligned with and disposed at least partially along the longitudinal axis of the at least one helical radiator; and the first and second linear radiators extend through one or more coils of the first and second helical radiators without galvanically coupling to the first and second helical radiators.

20. The antenna assembly of claim 15, wherein:

the first linear radiator extends through one or more coils of the first helical radiator without galvanically coupling to the first helical radiator; and the second linear radiator extends through one or more coils of the second helical radiator without galvanically coupling to the second helical radiator.

21. The antenna assembly of claim 20, wherein the second linear radiator extends through one or more coils of the first helical radiator without galvanically coupling to the first helical radiator.

* * * * *